US007375068B2

(12) United States Patent
Yagi et al.

(10) Patent No.: US 7,375,068 B2
(45) Date of Patent: May 20, 2008

(54) ANTI-SOILING DETERGENT COMPOSITION COMPRISING A POLYETHERAMIDE-MODIFIED ORGANOPOLYSILOXANE

(75) Inventors: Mari Yagi, Tokyo (JP); Mitsuo Sado, Yokohama (JP); Aki Inageta, Tokyo (JP)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 11/877,288

(22) Filed: Oct. 23, 2007

(65) Prior Publication Data

US 2008/0041418 A1 Feb. 21, 2008

Related U.S. Application Data

(63) Continuation of application No. 10/532,321, filed on Apr. 22, 2005, which is a continuation of application No. PCT/US03/33396, filed on Oct. 21, 2003.

(30) Foreign Application Priority Data

Oct. 25, 2002 (JP) ..... 2002-310790
Oct. 16, 2003 (JP) ..... 2003-356224

(51) Int. Cl.
*C11D 9/36* (2006.01)

(52) U.S. Cl. ..... 510/238; 510/362; 510/432; 510/466; 510/476; 510/480

(58) Field of Classification Search ..... 510/238, 510/362, 432, 466, 476, 480
See application file for complete search history.

(56) References Cited

U.S. PATENT DOCUMENTS 5,965,649 A * 10/1999 Kondo et al. ..... 524/320
6,972,279 B2 * 12/2005 Deak et al. ..... 510/466

* cited by examiner

*Primary Examiner*—Charles Boyer
(74) *Attorney, Agent, or Firm*—Gregory S. Bollis

(57) ABSTRACT

To provide an anti-soiling detergent composition that has excellent detergency, endows cleaned surfaces with a pronounced anti-soiling effect, effectively sustains the anti-staining effect, possesses superb storage stability, and can be used on restrooms, sinks, baths, and other damp, hard surfaces.

The anti-soiling detergent composition contains (A) 0.05 to 10 mass % of a polyetheramide-modified organopolysiloxane and/or amino-modified organopolysiloxane, (B) 0.1 to 30 mass % of a specific surfactant, (C) 0.1 to 20 mass % of a metal chelating agent, and (D) water.

20 Claims, No Drawings

ANTI-SOILING DETERGENT COMPOSITION COMPRISING A POLYETHERAMIDE-MODIFIED ORGANOPOLYSILOXANE

CROSS-REFERENCE TO RELATED APPLICATIONS

This is a continuation of U.S. patent application Ser. No. 10/532,321 filed Apr. 22, 2005, which claims priority to PCT Application No. PCT/US03/33396 filed Oct. 21, 2003, which claims priority to Japanese Application No. 2002-310790 filed Oct. 25, 2002, and Japanese Application No. 2003-356224 filed Oct. 16, 2003.

TECHNICAL FIELD

The present invention relates to an anti-soiling detergent composition that possesses excellent storage stability and has a sustained anti-soiling effect on cleaned surfaces in addition to exhibiting superior detergency.

BACKGROUND ART

Depending on the location of use, various types of soil deposit on the hard surfaces of baths, washstands, restrooms, and other damp locations. For example, the soil in baths comprises proteins and other nitrogenous compounds, fatty acid metal salts, or the like; the soil in washstands comprises fatty acid metal salts and the like; and the soil in restrooms comprises urolith deposits, soil that is based on fecal matter, urine, and other types of excrement, and the like. In addition, these hard surfaces undergo repeated drying after coming into constant contact with tap water, so silicate scale or carbonate scale derived from tap water are concentrated and deposited locally, producing soil commonly referred to as "water spots" or "water stains." In particular, the restroom bowls, washbowls, and other ceramic fixtures, as well as mirrors and other glass surfaces in restroom areas are hydrophilic, and therefore tend to be covered with water stains.

If such water stains continue to build up over a long time, the water stains bond firmly with the hard surfaces, and not only does removal become more difficult, but the components of the water stains tend to become a breeding ground for mold and germs together with other types of soil, and sanitary problems are encountered. Initial water stains can be removed relatively easily by careful cleaning, but currently the situation is such that the frequency of cleaning tends to decrease due to the streamlining of cleaning operations.

In view of this, a need exists for detergents that have the ability (anti-soiling effect) to reduce deposits of water stains and other types of soil, and detergents that clean and at the same time endow cleaned surfaces with the anti-soiling effect have come to be developed in order to prevent water stains from firmly adhering to hard surfaces. Detergents endowed with the ability to form films on the cleaned surfaces and to provide an anti-soiling effect by the incorporation of specific organopolysiloxanes into the detergent composition have been proposed as products that combine such an anti-soiling effect.

Examples of disclosed detergents that combine an anti-soiling effect and contain such organopolysiloxanes include compositions for bathtub cleaning that contain amino-modified organopolysiloxanes and nonionic surfactants, inhibit redeposition of water-formed deposits, and have protective action on bathtub materials (refer, for example, to Japanese Patent Application Laid-open No. S51-83608), as well as detergent compositions that contain specific organopolysiloxane and provide delustering and surface protection to bath fixtures (refer, for example, to Japanese Patent Application Laid-open No. H3-197596). Also disclosed is a detergent composition for the desoiling and antibacterial cleaning of hard surfaces that contains specific cationic surfactants, cation-based bactericidal agents, and hydrophilic organopolysiloxanes and has an anti-soiling effect and antibacterial action (refer, for example, to Japanese Patent Application Laid-open No. 2000-198999).

Japanese Patent Application Laid-open Nos. S51-83608 and H3-197596 disclose detergent compositions that have excellent anti-soiling effects and detergency with respect to water-formed deposits and soil, but there is no mention of an anti-soiling effect on water stains, nor is there any disclosure made concerning sustained anti-soiling effects or storage stability, which are believed to be important in practical terms. Japanese Patent Application Laid-open No. 2000-198999 discloses a detergent composition that has an excellent anti-soiling effect on water stains.

DISCLOSURE OF THE INVENTION

The prior art does not disclose or recognize the need for storage stability or details of detergency, and a detergent that simultaneously satisfies all the requirements related to enhanced detergency, excellent anti-soiling effects, and adequate storage stability has yet to be developed.

A need therefore exists for developing a detergent that would exhibit excellent anti-soiling effects and storage stability in addition to excellent detergency even in restrooms, washstands, baths, and other locations in repeated contact with tap water.

An object of the present invention is to provide a detergent composition that combines an excellent anti-soiling effect on cleaned surfaces, preserves this anti-soiling effect, and exhibits excellent storage stability in addition to having excellent detergency. More specifically, the object is to provide an anti-soiling detergent composition that can be used to advantage for cleaning and anti-soiling of hard surfaces such as those of plastic, stainless steel, porcelain, tile, glass, ceramic, granite/terrazzo, and other natural stone materials in restrooms, washstands, baths, and other damp locations; particularly, for cleaning and anti-soiling of water stains on hard surfaces such as those of tile, glass, and ceramic in restroom and washstands.

The inventors have discovered that an anti-soiling detergent composition that has an excellent anti-soiling effect on cleaned surfaces, preserves this anti-soiling effect, and exhibits excellent storage stability in addition to having excellent detergency can be obtained by combining a polyetheramide-modified organopolysiloxane and/or amino-modified organopolysiloxane, a surfactant, a metal chelating agent, and water. The present invention was perfected on the basis of this discovery.

Specifically, the present invention provides an anti-soiling detergent composition which comprises an anti-soiling detergent composition which comprises:

(A) 0.05 to 10 mass % of a polyetheramide-modified organopolysiloxane and/or amino-modified organopolysiloxane;

(B) 0.1 to 30 mass % of at least one type of surfactant selected from nonionic surfactants, amphoteric surfactants, and cationic surfactants;

(C) 0.1 to 20 mass % of a metal chelating agent; and (D) water.

The anti-soiling detergent composition of the invention may also contain (E) 0.01 to 5 mass % of a thickener in addition to components (A) to (D).

The anti-soiling detergent composition of the invention may further contain (F) 0.1 to 20 mass % of a water-soluble solvent in addition to the above components.

The anti-soiling detergent composition of the present invention contains components (A), (B), (C), and (D) as essential ingredients.

The component (A) used in the present invention is a polyetheramide-modified organopolysiloxane and/or amino-modified organopolysiloxane, and it is added with the purpose of endowing the cleaned surface with an anti-soiling effect.

The polyetheramide-modified organopolysiloxane of component (A) used in the present invention may be a organopolysiloxane having polyoxyethylene groups and amido groups expressed by average compositional formula (1)

$$R^1_aR^2_bQ^1_cQ^2_dSiO_{(4-a-b-c-d)/2} \quad (1)$$

In average compositional formula (1), a and d are zero or positive numbers; b and c are positive numbers such that $1.9 \leqq a+b+c+d \leqq 2.2$; and $R^1$ is a hydrogen atom, a hydroxyl group, or a substituted or unsubstituted monovalent hydrocarbon group with 1 to 6 carbon atoms. Specific examples of such monovalent hydrocarbon groups include methyl, ethyl, propyl, butyl, pentyl, hexyl, and other alkyl groups; phenyl, tolyl, xylyl, and other aryl groups; benzyl, phenethyl, and other aralkyl groups; and 3-chloropropyl, 3,3,3-trifluoropropyl, and other halo-substituted alkyl groups.

In formula (1), $R^2$ is a monovalent hydrocarbon group with 1 to 6 carbon atoms, specific examples of which include methyl, ethyl, propyl, butyl, pentyl, hexyl, vinyl, and phenyl groups.

In formula (1), $Q^1$ is a divalent organic group having an amido group expressed by general formula (2) or (3)

[Chemical Formula 4]

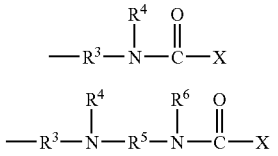

(2)

(3)

In general formulae (2) and (3), $R^3$ and $R^5$ are divalent hydrocarbon groups with 2 to 18 carbon atoms, specific examples of which include ethylene, propylene, butylene, isobutylene, pentamethylene, octamethylene, decamethylene, dodecamethylene, and cyclohexyl groups. In the formulae, $R^4$ and $R^6$ are hydrogen atoms or monovalent hydrocarbon groups with 1 to 6 carbon atoms, specific examples of which include methyl, ethyl, propyl, butyl, pentyl, hexyl, and other alkyl groups; phenyl, tolyl, xylyl, and other aryl groups; benzyl, phenethyl, and other aralkyl groups; and 3-chloropropyl, 3,3,3-trifluoropropyl, and other halo-substituted alkyl groups.

In general formulae (2) and (3), X is a monovalent organic group expressed by general formula (4)

$$—R^7_eO_f—(C_2H_4O)_g—(R^8O)_h—Y \quad (4),$$

where e and f are each 0 or 1, and g and h are zeros or positive integers of 1 or greater. $R^7$ is a divalent hydrocarbon group with 2 to 18 carbon atoms, specific examples of which include ethylene, propylene, butylene, isobutylene, pentamethylene, octamethylene, decamethylene, dodecamethylene, and cyclohexyl groups. $R^8$ is a divalent hydrocarbon group with 3 to 10 carbon atoms, specific examples of which include propylene, isopropylene, butylene, and isobutylene groups. Y is a group selected from among hydrogen atoms, alkyl groups, acyl groups, and isocyanic groups, examples of which include methyl, ethyl, propyl, acetyl, and propionyl groups.

In formula (1), $Q^2$ is a monovalent organic group having a polyoxyalkylene group expressed by general formula (5)

$$—R^9_iO_j—(C_2H_4O)_k—(R^{10}O)_m—Z \quad (5)$$

where i and j are each 0 or 1; k is a positive integer of 1 or greater; m is zero or a positive number of 1 or greater; and $R^9$ is a divalent hydrocarbon group with 2 to 18 carbon atoms, specific examples of which include ethylene, propylene, butylene, isobutylene, pentamethylene, octamethylene, decamethylene, dodecamethylene, and cyclohexyl groups. $R^{10}$ is a divalent hydrocarbon group with 3 to 10 carbon atoms, specific examples of which include propylene, isopropylene, butylene, and isobutylene groups. Z is a group selected from among hydrogen atoms, alkyl groups, acyl groups, and isocyanic groups, examples of which include methyl, ethyl, propyl, acetyl, and propionyl groups.

The molecular structure of the polyetheramide-modified organopolysiloxane may be not only linear but also branched, cyclic, or reticulated.

The polyetheramide-modified organopolysiloxane having such amido groups and polyoxyethylene groups may, for example, be a compound expressed by the following general formula.

[Chemical Formula 5]

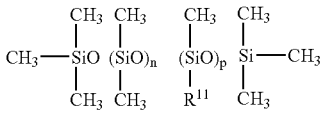

(In the formula, $R^{11}$ is $—(CH_2)_3NHCO(CH_2)_qO(CH_2CH_2O)_r(CH_2)_sH$, where n is 10 to 1000, p is 1 to 100, q is 1 to 100, r is 2 to 20, and s is 0 to 20.)

[Chemical Formula 6]

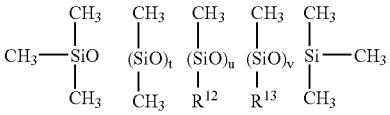

(In the formula, $R^{12}$ is $—(CH_2)_3NH(CH_2)_2NHCO(CH_2)_wH$, $R^{13}$ is $—(CH_2)_3O(CH_2CH_2O)_x(CH_2CHCH_3O)_y(CH_2)_2H$, t is 10 to 1000, u is 1 to 100, v is 1 to 100, w is 1 to 20, x is 2 to 20, y is 0 to 20, and z is 0 to 20.)

[Chemical Formula 7]

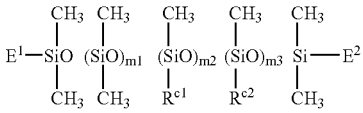

(In the formula, $R^{c1}$ is $—(CH_2)_3NHCO(CH_2)_{m4}O_{m5}(CH_2CH_2O)_{m6}(CH_2CHCH_3O)_{m7}(CH_2)_{m8}H$; $R^{c2}$ is $—(CH_2)_3O(CH_2CH_2O)_{m9}(CH_2CHCH_3O)_{m10}(CH_2)_{m11}D^1$; $E^1$ and $E^2$, which may be the same or different are $R^{c1}$, $R^{c2}$, —OH, or —$(CH_2)_{p1}H$, and preferably —$CH_3$; $D^1$ is —H or $COCH_3$; m1 is 10 to 1000; m2 is 1 to 100; m3 is 0 to 100; m4 is 1 to 100; m5 is 0 or 1; m6 is 0 to 20; m7 is 0 to 20; m8 is 0 to 20; m9 is 2 to 20; m10 is 0 to 20; m11 is 0 to 20; p1 is 0 to 20; and m3 and m6 cannot both be 0 at the same time.)

[Chemical Formula 8]

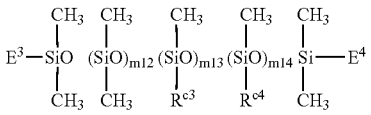

(In the formula, $R^{c3}$ is —$(CH_2)_3NH(CH_2)_2NHCO(CH_2)_{m15}O_{m16}(CH_2CH_2O)_{m17}(CH_2CHCH_3O)_{m18}(CH_2)_{m19}H$; $R^{c4}$ is —$(CH_2)_3NH(CH_2CH_3O)_{m20}(CH_2CHCH_3O)_{m21}(CH_2)_{m22}D^2$; $E^3$ and $E^4$, which may be the same or different, are $R^{c3}$, $R^{c4}$, —OH, or —$(CH_2)_{p2}H$, and preferably —$CH_3$; $D^2$ is —H or —$COCH_3$; m12 is 10 to 1000; m13 is 1 to 100; m14 is 0 to 100; m15 is 1 to 100; m16 is 0 or 1; m17 is 0 to 20; m18 is 0 to 20; m19 is 0 to 20; m20 is 2 to 20; m21 is 0 to 20; m22 is 0 to 20; p2 is 0 to 20; and m14 and m17 cannot both be 0 at the same time.)

Compounds having chemical structures such as those shown below can be cited as specific examples.

[Chemical Formula 9]

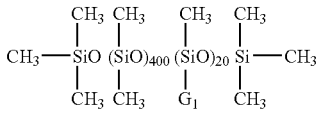

(In the formula, $G^1$ is $(CH_2)_3NHCOCH_2O(CH_2CH_2O)_4C_{12}H_{25}$.)

[Chemical Formula 10]

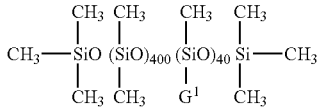

(In the formula, $G^2$ is $(CH_2)_3NH(CH_2)_2NHCO(CH_2)_3O(CH_2CH_2O)_{10}C_{12}H_{25}$.)

[Chemical Formula 11]

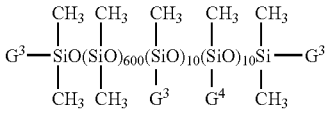

(In the formula, $G^3$ is $(CH_2)_3O(CH_2CH_2O)_{10}(CH_2CHCH_3O)_{10}H$, and $G^4$ is $(CH_2)_3NHCO(CH_2)_3O(CH_2CH_2O)_6C_{10}H_{21}$.)

[Chemical Formula 12]

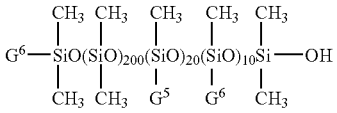

(In the formula, $G^5$ is $(CH_2)_3O(CH_2CH_2O)_{10}(COCH_3$, and $G^6$ is $(CH_2)_3NH(CH_2)_2NHCOC_{16}H_{33}$.)

The polyetheramide-modified organopolysiloxane of component (A) used in the present invention may also be a organopolysiloxane having an amino group, polyoxyethylene group, and amido group expressed by average compositional formula (6)

$$R^1{}_aR^2{}_bQ^1{}_cQ^2{}_dQ^3{}_{e1}SiO_{(4a-b-c-d-e1)/2} \quad (6)$$

In formula (6), a and d are zeros or positive numbers; b, c, and e1 are positive numbers such that $1.9 \leqq a+b+c+d+e1 \leqq 2.2$; and $R^1$ is a hydrogen atom, a hydroxyl group, or a substituted or unsubstituted monovalent hydrocarbon group with 1 to 6 carbon atoms. Specific examples of such monovalent hydrocarbon groups include methyl, ethyl, propyl, butyl, pentyl, hexyl, and other alkyl groups; phenyl, tolyl, xylyl, and other aryl groups; benzyl, phenethyl, and other aralkyl groups; and 3-chloropropyl, 3,3,3-trifluoropropyl, and other halo-substituted alkyl groups.

In formula (6), $R^2$ is a monovalent hydrocarbon group with 1 to 6 carbon atoms, specific examples of which include methyl, ethyl, propyl, butyl, pentyl, hexyl, vinyl, and phenyl groups.

In formula (6), $Q^1$ is a divalent organic group having an amido group expressed by general formula (2) or (3)

[Chemical Formula 13]

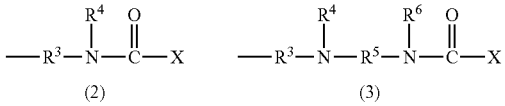

In general formulae (2) and (3), $R^3$ and $R^5$ are divalent hydrocarbon groups with 2 to 18 carbon atoms, specific examples of which include ethylene, propylene, butylene, isobutylene, pentamethylene, octamethylene, decamethylene, dodecamethylene, and cyclohexyl groups. In the formulae, $R^4$ and $R^6$ are hydrogen atoms or monovalent hydrocarbon groups with 1 to 6 carbon atoms, specific examples of which include methyl, ethyl, propyl, butyl, pentyl, hexyl, and other alkyl groups; phenyl, tolyl, xylyl, and other aryl groups; benzyl, phenethyl, and other aralkyl groups; and 3-chloropropyl, 3,3,3-trifluoropropyl, and other halo-substituted alkyl groups.

In general formulae (2) and (3), X is a monovalent organic group expressed by general formula (4)

$$—R^7{}_eO_f—(C_2H_4O)_g—(R^8O)_h—Y \quad (4),$$

where e and f are each 0 or 1, and g and h are zeros or positive integers of 1 or greater. $R^7$ is a divalent hydrocarbon group with 2 to 18 carbon atoms, specific examples of which include ethylene, propylene, butylene, isobutylene, pentamethylene, octamethylene, decamethylene, dodecamethylene, and cyclohexyl groups. $R^8$ is a divalent hydrocarbon group with 3 to 10 carbon atoms, specific examples of which include propylene, isopropylene, butylene, and isobutylene groups. Y is a group selected from among hydrogen atoms, alkyl groups, acyl groups, and isocyanic groups, examples of which include methyl, ethyl, propyl acetyl, and propionyl groups.

In formula (6), $Q^2$ is a monovalent organic group having a polyoxyalkylene group expressed by general formula (5)

$$—R^9{}_iO_j—(C_2H_4O)_k—(R^{10}O)_m—Z \quad (5),$$

where i and j are each 0 or 1; k is a positive integer of 1 or greater; m is zero or a positive integer of 1 or greater; $R^9$ is a divalent hydrocarbon group with 2 to 18 carbon atoms, specific examples of which include ethylene, propylene, butylene, isobutylene, pentamethylene, octamethylene, decamethylene, dodecamethylene, and cyclohexyl groups; $R^{10}$ is a divalent hydrocarbon group with 3 to 10 carbon atoms, specific examples of which include propylene, isopropylene, butylene, and isobutylene groups; and Z is a group selected from among hydrogen atoms, alkyl groups, acyl groups, and isocyanic groups, examples of which include methyl, ethyl, propyl, acetyl, and propionyl groups.

In formula (6), $Q^3$ is a divalent organic group having an amino group expressed by general formula (7) or (8)

[Chemical Formula 14]

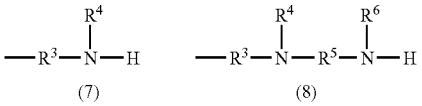

(7) (8)

In general formulae (7) and (8), $R^3$ to $R^6$ are the same as above.

Because of considerations related to the sustainability of the anti-soiling effect, the total amount of the primary and secondary amino groups of general formula (7) or (8) contained in the polyetheramide-modified organopolysiloxane molecules is preferably within a range of 0.15 to 0.45 mass %. When the total content of the primary and secondary amino groups is less than 0.15 mass %, the anti-soiling effect has inferior sustainability because of the poor adsorption of the polyetheramide-modified organopolysiloxane on the cleaned surfaces, whereas the composition has inferior storage stability when the content exceeds 0.45 mass %.

The molecular structure of the polyetheramide-modified organopolysiloxane may be not only linear but also branched, cyclic, or reticulated.

The polyetheramide-modified organopolysiloxane having such amido groups, polyoxyethylene groups, and amino groups may, for example, be a compound expressed by the following general formula.

[Chemical Formula 15]

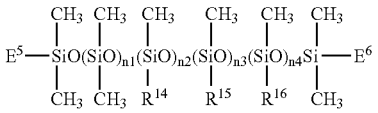

(In the formula, $R^{14}$ is $—(CH_2)_3O(CH_2CH_2O)_{n5}(CH_2CHCH_3O)_{n6}(CH_2)_{n7}D^3$; $R^{15}$ is $—(CH_2)_3NH_2$; $R^{16}$ is $—(CH_2)_3NHCO(CH_2)_{n8}O_{n9}(CH_2CH_2O)_{n10}(CH_2CHCH_3O)_{n11}(CH_2)_{n12}H$; $E^5$ and $E^6$, which may be the same or different, are $R^{14}$, $R^{15}$, $R^{16}$, —OH, or $—(CH_2)_{p3}H$, and preferably $—CH_3$; $D^3$ is —H or $—COCH_3$; n1 is 10 to 1000; n2 is 0 to 100; n3 is 1 to 100; n4 is 1 to 100; n5 is 2 or 20; n6 is 0 to 20; n7 is 0 to 20; n8 is 1 to 100; n9 is 0 or 1; n10 is 0 to 20; n11 is 0 to 20; n12 is 0 to 20; p3 is 0 to 20; and n2 and n10 cannot both be 0 at the same time.)

[Chemical Formula 16]

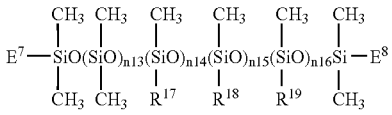

(In the formula, $R^{17}$ is $—(CH_2)_3O(CH_2CH_2O)_{n17}(CH_2CHCH_3O)_{n18}(CH_2)_{n19}D^4$; $R^{18}$ is $—(CH_2)_3NH(CH_2)_2NH_2$; $R^{19}$ is $—(CH_2)_3NH(CH_2)_2NHCO(CH_2)_{n20}O_{n21}(CH_2CH_2O)_{n22}(CH_2CHCH_3O)_{n23}(CH_2)_{n24}H$; $E^7$ and $E^8$, which may be the same or different, are $R^{17}$, $R^{18}$, $R^{19}$, —OH, or $—(CH_2)_{p4}H$, and preferably $—CH_3$; $D^4$ is —H or $—COCH_3$; n13 is 10 to 1000; n14 is 0 to 100; n15 is 1 to 100; n16 to 100; n17 is 2 or 20; n18 is 0 to 20; n19 is 0 to 20; n20 is 1 or 100; n21 is 0 or 1; n22 is 0 to 20; n23 is 0 to 20; n24 is 0 to 20; p4 is 0 to 20; and n14 and n22 cannot both be 0 at the same time.)

Compounds having chemical structures such as those shown below can be cited as specific examples.

[Chemical Formula 17]

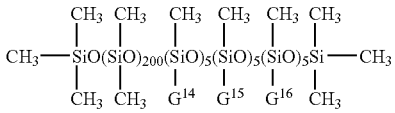

(In the formula ($G^{14}$ is $—(CH_2)_3O(CH_2CH_2O)_5C_{12}H_{25}$, $G^{15}$ is $—(CH_2)_3NH_2$, and $G^{16}$ is $—(CH_2)_3NHCOCH_2O(CH_2CH_2O)_5C_{12}H_{25}$.)

[Chemical Formula 18]

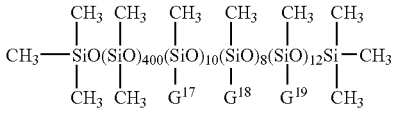

(In the formula ($G^{17}$ is $—(CH_2)_3O(CH_2CH_2O)_{10}C_{10}H_{21}$, ($G^{18}$ is $—(CH_2)_3NH(CH_2)_2NH_2$, and $G^{19}$ is $—(CH_2)_3NH(CH_2)_2NHCOCH_2O(CH_2CH_2O)_4C_{10}H_{21}$.)

The amino-modified organopolysiloxane of component (A) used in the present invention is commonly known as amino-modified organopolysiloxane, which is commercially available. It is possible, for example, to use an amino-modified product of a organopolysiloxane in which some of the methyl groups in the polydimethylsiloxane are substituted by at least one type of group selected from organic groups having amino groups or substituted amino groups, such as aminomethyl, aminoethyl, aminopropyl, aminobutyl, and other aminoalkyl groups, as well as aminoethyl-substituted aminopropyl and other aminoalkyl-substituted aminoalkyl groups (other substituents may also be contained).

Among these, compounds expressed by the following general formula are preferably used because of considerations related to anti-soiling effects.

[Chemical Formula 19]

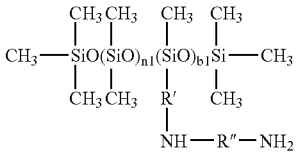

(In the formula, R' and R" are divalent hydrocarbon groups with 1 to 10 carbon atoms, a1 is zero or a positive number of 1 or greater, and b1 is a positive number of 1 or greater.)

In the above general formula, the same groups as those described above can be cited as examples of the divalent hydrocarbon groups with 1 to 10 carbon atoms. Using a polyetheramide-modified organopolysiloxane for component (A) is more preferred from the standpoint of storage stability.

The admixed amount of component (A) is selected from the range of 0.05 to 10 mass %, based on the total mass of the composition. An inferior anti-soiling effect will be produced if this amount is less than 0.05 mass %, and the increase in the anti-soiling effect will reach saturation and the economic efficiency will actually be low if more than 10 mass % is admixed. The admixed amount of component (A) is preferably within a range of 0.1 to 8 mass % because of considerations related to the anti-soiling effect and storage stability, and even more preferably within a range of 0.1 to 5 mass % because of considerations related to economic efficiency. Component (A) may be used singly or as a combination of two or more ingredients.

The surfactant of component (B) used in the present invention is admixed with the purpose of removing the soil adhered to the cleaned surface and solubilizing the polyetheramide-modified organopolysiloxane and/or amino-modified organopolysiloxane, which is component (A).

At least one type of surfactant selected from among nonionic surfactants, amphoteric surfactants, and cationic surfactants is used as the surfactant of component (B) because of considerations related to the anti-soiling effect, which is the effect possessed by component (A).

Examples of such nonionic surfactants include polyoxyalkylene alkyl ethers, polyoxyalkylene alkenyl ethers, polyoxyalkylene alkyl phenyl ethers, alkyl polyglucosides, fatty acid polyglycerine esters, fatty acid sugar esters, and fatty acid alkanolamides. In the present invention, polyoxyalkylene alkyl ethers, alkyl polyglucosides, and fatty acid alkanolamides are preferred among these nonionic surfactants because of considerations related to detergency, and polyoxyalkylene alkyl ethers and alkyl polyglucosides are even more preferred because of considerations related to economic efficiency.

Examples of amphoteric surfactants include alkyl carboxybetaines, alkyl sulfobetaines, alkyl hydroxysulfobetaines, alkyl amidobetaines, imidazolinium betaines, alkyl diaminoethyl glycines, dialkyl diaminoethyl glycines, alkyl amine oxides, alkyl ether amine oxides, and amide/amine oxides. In the present invention, alkyl carboxybetaines, alkyl sulfobetaines, alkyl hydroxysulfobetaines, alkyl amidobetaines, alkyl amine oxides, alkyl ether amine oxides, and amide/amine oxides are preferred among these amphoteric surfactants because of considerations related to detergency, and alkyl amidobetaines and alkyl amine oxides are even more preferred because of considerations related to economic efficiency.

Examples of cationic surfactants include alkyl trimethylammonium salts, dialkyl dimethylammonium salts, alkyl trimethylammonium salts, alkyl dimethylammonium adipates, benzalkonium salts, benzethonium salts, pyridinium salts, imidazolinium salts, and biguanide compounds. The counterions of these cationic surfactants are halogen ions and the like. In the present invention, dialkyl dimethylammonium salts, alkyl dimethylammonium adipates, benzalkonium salts, benzethonium salts, and biguanide compounds are preferred among these cationic surfactants because of considerations related to bactericidal properties and economic efficiency, and benzalkonium chloride and dialkyl dimethylammonium chlorides are even more preferred because of considerations related to the anti-soiling effect.

These surfactants may be used singly or as combination of two or more components, and can be appropriately selected and used in accordance with detergency on the soil, foaming properties, rinsing properties, mildness on the skin, damage to the material, ease of wiping, and other required performance attributes.

The admixed amount of component (B) is selected from the range of 0.1 to 30 mass % of the composition. The detergency and the anti-soiling effect of component (A) will be limited if this amount is less than 0.1 mass %, and the increase in detergency will reach saturation and the economic efficiency will actually decline if more than 30 mass % is admixed. The amount in which the surfactant is admixed is preferably within a range of 1 to 30 mass %, based on the total mass of the composition, because of considerations related to detergency, and even more preferably within a range of 1 to 15 mass % because of considerations related to economic efficiency.

Examples of the metal chelating agent of component (C) used in the present invention include hydroxycarboxylic acids, aminocarboxylic acids, phosphoric acids, phosphonic acids, phosphonocarboxylic acids, water-soluble macromolecular polymers, salts thereof, and other compounds that are soluble in water and have a chelating capacity. These may be used singly or as combinations of two or more compounds. The metal chelating agent is admixed with the purpose of obtaining enhanced detergency.

Examples of hydroxycarboxylic acids include acetic acid, adipic acid, monochloroacetic acid, oxalic acid, succinic acid, oxydisuccinic acid, carboxymethylsuccinic acid, carboxymethyloxysuccinic acid, glycolic acid, diglycolic acid, lactic acid, tartaric acid, carboxymethyltartaric acid, citric acid, malic acid, gluconic acid, and salts thereof.

Examples of aminocarboxylic acids include nitrilotriacetic acid, iminodiacetic acid, ethylenediamine tetraacetic acid, diethylenetriamine pentaacetic acid, N-hydroxyethyl ethylenediamine acetic acid, ethylenediamine tetrapropionic-acetic acid, methyl glycine diacetic acid, triethylenetetramine hexaacetic acid, ethylene glycol diether diamine tetraacetic acid, hydroxyethyliminodiacetic acid, cyclohexane-1,2-diaminotetraacetic acid, djenkolic acid, and salts thereof.

Examples of phosphoric acids include orthophosphoric acid, pyrophosphoric acid, tripolyphosphoric acid, metaphosphoric acid, hexametaphosphoric acid, phytic acid, and other condensed phosphoric acids, as well as salts thereof.

Examples of phosphonic acids include ethane-1,1-diphosphonic acid, ethane-1,1,2-triphosphonic acid, 1-hydroxyethane-1,1-diphosphonic acid, derivatives thereof, 1-hydroxyethane-1,1,2-triphosphonic acid, ethane-1,2-dicarboxy-1,2-diphosphonic acid, methane hydroxyphosphonic acid, aminotrimethylene phosphonic acid, and salts thereof.

Examples of phosphonocarboxylic acids include 2-phosphonobutane-1,2-dicarboxylic acid, 1-phosphonobutane-2,3,4-tricarboxylic acid, α-methylphosphonosuccinic acid, and salts thereof.

Examples of water-soluble macromolecular polymers include polyacrylic acid, polymaleic acid, copolymers of acrylic acid and maleic acid, polyaconitic acid, poly-α-hydroxyacrylic acid, polymethacrylic acid, and salts thereof.

These metal chelating agents may be used in the form of acids or as partial or complete salts. Examples of such salts include salts of potassium, sodium, and other alkali metals; monoalkanolamines, diethanolamine, triethanolamine, and other alkanolamine salts; and ammonium salts.

Hydroxycarboxylic acids, aminocarboxylic acids, alkali metal salts thereof, and alkanolamine salts are preferred among these metal chelating agents because of considerations related to the impact on the environment, and hydroxycarboxylic acids, aminocarboxylic acids, and sodium salts thereof are even more preferred because of considerations related to economic efficiency.

The admixed amount of component (C) is selected from the range of 0.1 to 20 mass % of the composition. A limited detergency improving effect will be produced if this amount is less than 0.1 mass %, and the detergency improving effect will reach saturation, the composition will have poor storage stability, and the economic efficiency will actually be low if more than 20 mass % is admixed. The amount in which the metal chelating agent is admixed is preferably within a range of 1 to 20 mass %, based on the total mass of the composition, because of considerations related to detergency, and even more preferably within a range of 1 to 15 mass % because of considerations related to economic efficiency.

Purified water, deionized water, soft water, distilled water, and tap water can be cited as examples of the water, or component (D), used in the present invention. These types of water may be used singly or as a combination of two or more types. Among these, tap water and deionized water are preferably used because of considerations related to economic efficiency and storage stability.

As used herein, the term "water" refers to the sum of water provided from the outside and water contained as the aqueous solution or crystal water derived from the components that constitute the anti-soiling detergent composition of the present invention. This water is admixed in such a way that the entire anti-soiling detergent composition constitutes 100%.

In the present invention, a thickener can also be admixed as component (E) according to need together with essential components (A) to (D). Component (E) is admixed in order to make the anti-soiling detergent composition of the present invention more usable through a thickening effect; particularly, to improve usability when spraying is employed or when a non-horizontal surface is cleaned, and hence to enhance detergency on non-horizontal surfaces.

Examples of the thickener that can be used as component (E) in the present invention include xanthan gum, carageenan, guar gum, gum arabic, locust bean gum, alginate, carboxymethylcellulose, and other thickening polysaccharides, as well as carboxyvinyl polymers, crosslinked polyacrylic acids, and salts thereof. In the present invention, xanthan gum and carboxyvinyl polymers are preferred among these because of considerations related to the stability of the composition.

The admixed amount of component (E) is selected from the range of 0.01 to 5 mass % of the composition. An inferior anti-soiling effect will be produced if this amount is less than 0.01 mass %, and the composition will become excessively viscous and difficult to handle, and the economic efficiency will actually be low if more than 5 mass % is admixed. The amount in which the thickener is admixed is preferably within a range of 0.05 to 2 mass %, based on the total mass of the composition, because of considerations related to the ease of operation, and even more preferably within a range of 0.05 to 1 mass % because of considerations related to economic efficiency.

In the present invention, a water-soluble solvent may be admixed as component (F) according to need together with essential components (A) to (D). Component (F) contributes to further improvements in detergency, particularly, detergency in relation to organic soil.

The following are examples of the water-soluble solvent, or component (F):

(1) Alcohols such as ethanol, propanol, isopropanol, butanol, and other monohydric alcohols; ethylene glycol, diethylene glycol, isoprene glycol, propylene glycol, and other alkylene glycols; and glycerin, polyglycerin, 1,3-butanediol, and other polyhydric alcohols (2) Glycol ethers such as ethylene glycol monomethyl ether, ethylene glycol dimethyl ether, ethylene glycol monoethyl ether, ethylene glycol monobutyl ether, propylene glycol monomethyl ether, propylene glycol monoethyl ether, propylene glycol monobutyl ether, propylene glycol monophenyl ether, diethylene glycol monomethyl ether, diethylene glycol monoethyl ether, diethylene glycol monobutyl ether, dipropylene glycol monomethyl ether, dipropylene glycol monoethyl ether, dipropylene glycol monobutyl ether, triethylene glycol monobutyl ether, tripropylene glycol dimethyl ether, and other alkylene glycol (mono-, di-) alkyl ethers (3) Limonene, pinene, terpinolene, myrcene, terpinene, phenanthrene, and other terpene-based hydrocarbon solvents These water-soluble solvents may be used singly or as combinations of two or more components, and can be appropriately selected and used in accordance with detergency on the soil, damage to the material, ease of wiping, and other required performance attributes.

Among these water-soluble solvents, lower alcohols with a carbon number of 1 to 5, glycol ethers, and terpene-based hydrocarbon solvents are preferred because of considerations related to detergency, and the following solvents are even more preferred because of considerations related to detergency, stability, and water solubility: lower alcohols with a carbon number of 1 to 5, propylene glycol monomethyl ether, propylene glycol monobutyl ether, diethylene glycol monobutyl ether, dipropylene glycol monomethyl ether, dipropylene glycol monobutyl ether, and limonene.

The admixed amount of component (F) is selected from the range of 0.1 to 20 mass % of the composition. Detergency will be limited if this amount is less than 0.1 mass %, and the increase in detergency will reach saturation, the economic efficiency will actually decline, and the composition will have unsatisfactory storage stability if more than 20 mass % is admixed. The amount in which the water-soluble solvent is admixed is preferably 1 to 15 mass % because of considerations related to detergency and storage stability, and is more preferably 1 to 10 mass % because of considerations related to economic efficiency, based on the total mass of the composition.

The stock solution for the anti-soiling detergent composition of the present invention is adjusted to a pH of 5 to 9, and preferably 6 to 8, taking into account the absence of any adverse effect on the material of the cleaning object, and biological and environmental safety. The pH can be adjusted using a substance that displays alkalinity and a substance that displays acidity.

Examples of alkaline substances that can be used for pH adjustment include sodium hydroxide, potassium hydroxide, and other alkali hydroxides; sodium carbonate, potassium carbonate, and other carbonates; sodium silicate, potassium silicate, and other silicates; monoethanolamine, diethanolamine, and other amines; and ammonia. Examples of acidic substances that can be used for pH adjustment include hydrochloric acid, sulfuric acid, and other inorganic acids, as well as citric acid, acetic acid, and other organic acids.

If an organic acid that corresponds to component (C) is used as the pH regulator, it must be taken into account that component (C) should be admixed in a ratio that does not fall outside the range of 0.1 to 20 mass %.

Fragrances, dyes, pigments, bactericides, preservatives, and the like may also be admixed as needed in addition to the aforementioned components into the anti-soiling detergent composition of the present invention as long as the objects of the present invention are not compromised.

The anti-soiling detergent composition of the present invention can be used to advantage for cleaning and desoiling hard surfaces that are in repeated contact with tap water and are prone to developing water stains; particularly, the hard surfaces of restrooms, washstands, baths, and the like. The materials of such cleaned surfaces include plastics, stainless steel, porcelain, tile, glass, ceramics, granite/terrazzo, and other natural stone materials.

The anti-soiling detergent composition of the present invention may be used either as a stock solution or after being diluted with water or warm water in accordance with the degree of soiling of the cleaned surface. The degree of dilution can be up to 50 times, based on considerations related to detergency and anti-soiling effect.

Examples of the cleaning methods in which the anti-soiling detergent composition of the present invention can be used include the following.

(1) A sponge or the like is impregnated with the anti-soiling detergent composition of the present invention, and a hard surface is scrubbed and rinsed.

(2) A cleaned surface is sprinkled with the anti-soiling detergent composition of the present invention, scrubbed with a sponge or the like, and rinsed.

(3) A cleaned surface is sprayed with the anti-soiling detergent composition of the present invention, allowed to stand for a while, and rinsed.

(4) In the case of a vertical surface, nonwoven fabric or the like is impregnated with the anti-soiling detergent composition of the present invention, affixed, allowed to stand for a while, and rinsed.

(5) A towel or duster is impregnated with the anti-soiling detergent composition of the present invention, the soil is wiped off, and the surface is wiped with a moist towel.

The present invention will now be described in further detail through examples and comparative examples with reference to the anti-soiling detergent composition of the present invention, but the present invention is not limited thereby.

EXAMPLES 1 TO 28, COMPARATIVE EXAMPLES 1 TO 18

The anti-soiling detergent compositions shown in Tables 1 to 8 were prepared and subjected to various tests. The numerical values for the components in the tables refer to the content (mass %) of each component. The pH was adjusted as needed with the aid of a pH regulator such as acetic acid, sulfuric acid, or sodium hydroxide, and the sum of components (A) to (F), the pH regulator, and arbitrary components was 100 mass % total. In Tables 1 to 8, the circle signs indicate cases in which a pH regulator was used.

The anti-soiling detergent compositions thus obtained were evaluated for test parameters such as pH, detergency, anti-soiling effect, sustainability of the anti-soiling effect, and storage stability by the test methods and in accordance with the grading system described below, and the results are presented as well in Tables 1 to 8 below.

(1) pH

A pH meter (pH METER F-12, manufactured by Horiba) was used to measure the pH value of a prepared stock solution of an anti-soiling detergent composition at 25° C. in accordance with JIS Z-8808: 1984.

(2) Detergency Test 1: Simulated Restroom Soil

[Preparation of Simulated Restroom Soil]

0.5 g of lanolin was dissolved in 5 mL of chloroform, 495 mL of ethanol was added for dilution, and an ethanol solution was prepared. A preparation obtained by dissolving 10 g of ferric chloride in 500 mL of water and adding the resulting solution to the ethanol solution was applied in the exact quantity of 1 mL to ceramic tile (SPKC-100/L00; white; 10 cm×10 cm; manufactured by INAX) whose surface had been pre-roughened with sandpaper (No. 120, manufactured by Nippon Coated Abrasive) that was moved back and forth ten times in the longitudinal and transverse direction, and caused to make 20 laps so that a circle was drawn. The coated tile was baked for 1 hour at 145° C. and allowed to cool at room temperature, yielding a test piece.

[Test Method]

5 mL of a stock solution of each composition was fed dropwise onto the test piece, a sponge (4 cm×8 cm) was moved back and forth 15 times with the aid of a washability tester (manufactured by Tester Sangyo), and a detergency test was performed. Following testing, the test piece was rinsed for 10 seconds with a certain amount of tap water and dried at room temperature. The whiteness of the test piece was measured before and after the test, and the cleaning ratio was determined using the formula shown below. The whiteness was measured using a color difference meter (Model CR-331, manufactured by Minolta).

Cleaning ratio (%)=(Whiteness after cleaning−Whiteness before cleaning)/(Whiteness before soil deposition−Whiteness before cleaning)×100

An evaluation was then performed based on the following grading system using these cleaning ratio values.

[Grading System]

⊙: Cleaning ratio of 80% or greater

○: Cleaning ratio of 60% or greater

Δ: Cleaning ratio of 40% or greater

×: Cleaning ratio of less than 40%

(3) Detergency Test 2: Simulated Soap Scum Soil

[Preparation of Simulated Soap Scum Soil]

A preparation obtained by dissolving 2.5 g of oleic acid, 2.5 g of triolein, 0.25 g of albumin, and 4.75 g of calcium stearate in 60 g of chloroform was uniformly applied in the exact quantity of 1 mL to slide glass (7.6 cm×2.6 cm). The slide glass was dried overnight at room temperature and used as a test piece.

[Test Method]

A stock solution of each composition was fed dropwise onto the test piece, and the test piece was scrubbed with a Conradi stick wrapped in tissue paper (Kim Wipe, manufactured by Crecia), which was moved back and forth 15 times to conduct the detergency test. Following testing, the test piece was rinsed for 10 seconds with a certain amount of tap water and dried at room temperature. The mass of the test piece was measured before and after the test, and the cleaning ratio was determined using the formula shown below.

Cleaning ratio (%)=(Mass of soil removed by detergency test/Mass of soil deposited before detergency test)×100

An evaluation was then performed based on the following grading system using these cleaning ratio values.

[Grading System]

⊙: Cleaning ratio of 80% or greater

○: Cleaning ratio of 60% or greater

Δ: Cleaning ratio of 40% or greater

×: Cleaning ratio of less than 40%

(4) Testing of Anti-Soiling Effect

[Test Method]

Ceramic tile (SPKC-100/L00; white; 10 cm×10 cm; manufactured by INAX) was cleaned using a sponge (4 cm×8 cm) with 2 mL of a stock solution of each composition, rinsed for 20 seconds with a certain amount of tap water, and dried at room temperature to obtain a test piece. Five drops of a solution obtained by dissolving 1 g of ferric chloride in 100 g of water were dropped in spots onto the test piece by using a dropping pipette, and the test piece was then baked for 3 hours at 105° C. and allowed to cool at room temperature. The soil was scrubbed off from the test piece with moistened tissue paper (Kim Wipe, manufactured by Crecia), and soil removal was visually evaluated.

[Grading System]

⊙: Soil was removed by light rubbing at all five locations

○: Soil was removed by forceful rubbing at all five locations

Δ: Soil was removed by forceful rubbing at four locations

×: Soil remained at two or more locations despite forceful rubbing (5) Test 1 of Sustainability of Anti-Soiling Effect

[Test Method]

A test was performed to determine the extent to which the anti-soiling effect could be sustained in actual applications involving the urinals, toilet bowls (both Japanese- and Western-style), and washstands at unisex restrooms cleaned once a day.

On the first day of the test, the urinals, toilet bowls, and washstands were scrubbed with a sponge by using a stock solution of each composition, and the scrubbed surfaces were then rinsed with running water. Starting on the next day for 6 days, the surfaces were scrubbed with a moistened sponge and merely rinsed with out using any detergent. During the cleaning on day 7, a stock solution of each composition was used in the same manner as on day 1, and the surfaces were scrubbed with a sponge and rinsed with water.

The cleaning in which stock solutions of each composition were used was continued in this manner once a week for 1 month (4 cycles), the extent of soiling was visually observed 1 month (4 cycles) after the start of the test, and the results were evaluated based on the following grading system.

[Grading System]

⊙: The same clean surfaces as a month prior, very little soil deposited, the cleaning time reduced ○: The surfaces unchanged from a month prior, but soil occasionally deposited Δ: More soil than a month prior ×: Much more soil than a month prior (6) Test 2 of Sustainability of Anti-Soiling Effect

[Test Method]

A test was performed to determine the extent to which the anti-soiling effect could be sustained in actual applications involving the urinals, toilet bowls (both Japanese- and Western-style), and washstands at unisex restrooms cleaned once a day.

On the first day of the test, the urinals, toilet bowls, and washstands were scrubbed with a sponge by using a stock solution of each composition, and the scrubbed surfaces were then rinsed with running water. Starting on the next day for 13 days, the surfaces were scrubbed with a moistened sponge and merely rinsed with out using any detergent. During the cleaning on day 14, a stock solution of each composition was used in the same manner as on day 1, and the surfaces were scrubbed with a sponge and rinsed with water.

The cleaning in which stock solutions of each composition were used was continued in this manner once every 2 weeks for 1 month (2 cycles), the extent of soiling was visually observed 1 month (2 cycles) after the start of the test, and the results were evaluated based on the following grading system.

[Grading System]

⊙: The same clean surfaces as a month prior, very little soil deposited, the cleaning time reduced ○: The surfaces unchanged from a month prior, but soil occasionally deposited Δ: More soil than a month prior ×: Much more soil than a month prior (7) Storage Stability Test 1: High-Temperature Stability

[Test Method]

Each composition was allowed to stand for 3 months in an incubator set to 50° C. (model IS82, manufactured by Yamato Scientific), and the presence or absence of precipitation, color changes, or separation was visually observed. An evaluation was made based on the following grading system.

[Grading System]

●: No precipitation, color changes, or separation observed in the composition at all ○: Slight precipitation, color changes, or separation observed in the composition Δ: Precipitation, color changes, or separation could clearly be seen occurring in the composition ×: Pronounced precipitation, color changes, or separation observed in the composition (8) Storage Stability Test 2: High-Temperature Stability

[Test Method]

Each composition was placed overnight in an incubator set to −15° C. (model HRF-90P, manufactured by Hoshizaki), allowed to freeze, and then caused to thaw at room temperature. This cycle was repeated five times, and the condition of the composition after 8 hours had elapsed since the start of thawing was visually observed. An evaluation was made based on the following grading system.

[Grading System]

●: No precipitation, color changes, or separation observed in the composition after 5 cycles of freezing/thawing ○: No precipitation, color changes, or separation observed in the composition after 4 cycles of freezing/thawing, but some precipitation, color changes, or separation observed during cycle 5

Δ: No precipitation, color changes, or separation observed in the composition after 3 cycles of freezing/thawing, but some precipitation, color changes, or separation observed during cycle 4

×: Precipitation, color changes, or separation observed in the composition before 3 cycles of freezing/thawing Details of the components shown in Tables 1 to 8 below are as follows.

Organopolysiloxane 1: A polyetheramide-modified organopolysiloxane expressed by the chemical formula

[Chemical Formula 20]

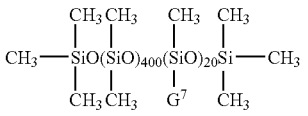

(In the formula $G^7$ is $(CH_2)_3NHCOCH_2O(CH_2CH_2O)_4C_{12}H_{25}$.)

Organopolysiloxane 2: A polyetheramide-modified organopolysiloxane expressed by the chemical formula

[Chemical Formula 21]

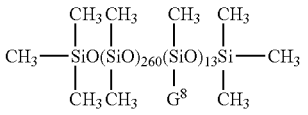

(In the formula $G^8$ is $(CH_2)_3NHCOCH_2O(CH_2CH_2O)_5C_{12}H_{25}$.)

Organopolysiloxane 3: A polyetheramide-modified organopolysiloxane expressed by the chemical formula

[Chemical Formula 22]

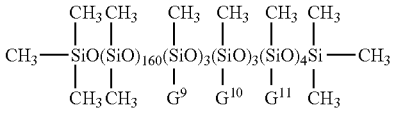

(In the formula $G^9$ is $(CH_2)_3O(CH_2CH_2O)_{10}C_{12}H_{25}$, $G^{10}$ is $(CH_2)_3NH_2$, and $G^{11}$ is $(CH_2)_3NHCOCH_2O(CH_2CH_2O)_5C_{12}H_{25}$.)

Organopolysiloxane 4: A polyetheramide-modified organopolysiloxane expressed by the chemical formula

[Chemical Formula 23]

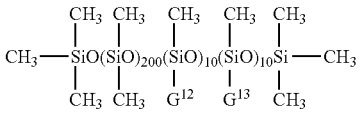

(In the formula $G^{12}$ is $(CH_2)_3O(CH_2CH_2O)_8C_{12}H_{25}$, and $G^{13}$ is $(CH_2)_3NHCOCH_2O(CH_2CH_2O)_4C_{12}H_{25}$.)

Organopolysiloxane 5: Amino-modified organopolysiloxane (Registered trade name: SF8417, manufactured by Toray Dow Corning Silicone)

Organopolysiloxane 6: Polyether-modified organopolysiloxane (Registered trade name: KF-6011, manufactured by Shin-Etsu Silicones)

Organopolysiloxane 7: Polydimethylsiloxane (Registered trade name: BY22-007, manufactured by Toray Dow Corning Silicone)

Nonionic surfactant 1: Alkyl polyglucoside (Registered trade name: 215CSUP, manufactured by Cognis Japan)

Nonionic surfactant 2: Polyoxyethylene alkyl ether (Registered Trade Name: Naroakty-ID70, Manufactured by Sanyo Chemical Industries)

Nonionic surfactant 3: Polyoxyethylene alkyl ether (Registered trade name: Lutensol T08, manufactured by BASF)

Amphoteric surfactant 1: Alkylamidopropyl betaine (Registered trade name: TegoBetain L10S, manufactured by Goldschmidt)

Amphoteric surfactant 2: Alkylamine oxide (Registered trade name: Barlox 12, manufactured by Lonza)

Cationic surfactant 1: Benzalkonium chloride (Registered trade name: Cation G-50, manufactured by Sanyo Chemical Industries)

Cationic surfactant 2: Didecyldimethylammonium chloride (Registered trade name: Bardac 2280, manufactured by Lonza)

Anionic surfactant 1: Sodium alkyl ether sulfonate (Registered trade name: Alscoap TH-330, manufactured by Toho Chemical Industry)

Anionic surfactant 2: Sodium alkylbenzenesulfonate (Registered trade name: Taycapower LN2450, manufactured by Tayca)

Thickener 1: Carboxyvinyl polymer (Registered trade name: Hiviswako 105, manufactured by Wako Pure Chemical Industries)

Thickener 2: Xanthan gum (registered trade name: Kelzan, manufactured by Kelco)

TABLE 1

| | | Examples | | | | | |
|---|---|---|---|---|---|---|---|
| | Admixed components | 1 | 2 | 3 | 4 | 5 | 6 |
| A | Organopolysiloxane 1 | 1.0 | 4.0 | 10.0 | 2.0 | | 0.5 |
| | Organopolysiloxane 2 | | 4.0 | | | 0.5 | |
| | Organopolysiloxane 3 | | | | | | |
| | Organopolysiloxane 4 | | | | | | |
| | Organopolysiloxane 5 | | | | | | |
| B | Nonionic surfactant 1 | 3.0 | 10.0 | 29.0 | 2.0 | | 2.0 |
| | Nonionic surfactant 2 | | | | 1.0 | | |
| | Nonionic surfactant 3 | | | | | | |
| | Amphoteric surfactant 1 | | 4.8 | | 1.0 | | |
| | Amphoteric surfactant 2 | 2.0 | | | | | |
| | Cationic surfactant 1 | 0.2 | 0.2 | 1.0 | 0.2 | 1.0 | |
| | Cationic surfactant 2 | | | | | | |

TABLE 1-continued

| | Admixed components | Examples 1 | 2 | 3 | 4 | 5 | 6 |
|---|---|---|---|---|---|---|---|
| C | NTA · 3Na | 20.0 | 15.0 | | | 4.0 | 4.0 |
| | Sodium citrate | | | 4.0 | | | |
| | Citric acid | | 4.0 | | | 1.0 | 1.0 |
| | EDTA · 4H | | | | 4.0 | | |
| D | Deionized water | Balance | Balance | Balance | Balance | Balance | Balance |
| E | Thickener 1 | | | | | | |
| | Thickener 2 | | | | | | |
| F | Diethylene glycol monobutyl ether | | | | | 15.0 | 20.0 |
| | Ethanol | | | | 10.0 | | |
| | Limonene | | | | | | |
| | Acetic acid (pH adjustment) | ○ | ○ | ○ | | ○ | ○ |
| | Sulfuric acid (pH adjustment) | | | | | | |
| | Sodium hydroxide (pH adjustment) | | | | ○ | | |
| Evaluation | pH | 7 | 7 | 7 | 7 | 7 | 7 |
| | Detergency 1 | ⊙ | ⊙ | ⊙ | ⊙ | ○ | ⊙ |
| | Detergency 2 | ⊙ | ⊙ | ⊙ | ⊙ | ○ | ⊙ |
| | Anti-soiling effect | ⊙ | ⊙ | ⊙ | ⊙ | ⊙ | ○ |
| | Sustainability of anti-soiling effect 1 | ⊙ | ⊙ | ⊙ | ⊙ | ⊙ | ○ |
| | Sustainability of anti-soiling effect 2 | ○ | ○ | ○ | ○ | ○ | ○ |
| | Storage stability 1 | ⊙ | ⊙ | ⊙ | ⊙ | ⊙ | ○ |
| | Storage stability 2 | ⊙ | ⊙ | ⊙ | ⊙ | ⊙ | ○ |

TABLE 2

| | Admixed components | Examples 7 | 8 | 9 | 10 | 11 | 12 |
|---|---|---|---|---|---|---|---|
| A | Organopolysiloxane 1 | 1.0 | | | 1.0 | 2.0 | 2.0 |
| | Organopolysiloxane 2 | | 1.0 | | | | |
| | Organopolysiloxane 3 | | | | | | |
| | Organopolysiloxane 4 | | | | | | |
| | Organopolysiloxane 5 | | | 1.0 | 1.0 | | |
| B | Nonionic surfactant 1 | 3.0 | 3.0 | 3.0 | 3.0 | | |
| | Nonionic surfactant 2 | | | | | 2.5 | |
| | Nonionic surfactant 3 | | | | | 0.5 | |
| | Amphoteric surfactant 1 | 1.0 | 1.0 | 1.0 | 1.0 | 1.0 | 3.0 |
| | Amphoteric surfactant 2 | | | | | | |
| | Cationic surfactant 1 | 0.2 | 0.2 | 0.2 | 0.2 | | |
| | Cationic surfactant 2 | | | | | 0.2 | |
| C | NTA · 3Na | 4.0 | 4.0 | 4.0 | 4.0 | 2.0 | 4.0 |
| | Sodium citrate | | | | | 2.0 | |
| | Citric acid | 0.7 | 0.7 | 0.7 | | | 1.0 |
| | EDTA · 4H | | | | | | |
| D | Deionized water | Balance | Balance | Balance | Balance | Balance | Balance |
| E | Thickener 1 | 0.4 | 0.4 | 0.4 | 1.0 | 0.4 | |
| | Thickener 2 | | | | | | 2.0 |
| F | Diethylene glycol monobutyl ether | | | | | | |
| | Ethanol | | | | | | |
| | Limonene | | | | | | |
| | Acetic acid (pH adjustment) | ○ | ○ | ○ | ○ | | ○ |
| | Sulfuric acid (pH adjustment) | | | | | ○ | |
| | Sodium hydroxide (pH adjustment) | | | | | | |
| Evaluation | pH | 7 | 7 | 7 | 7 | 7 | 7 |
| | Detergency 1 | ⊙ | ⊙ | ⊙ | ⊙ | ⊙ | ⊙ |
| | Detergency 2 | ⊙ | ⊙ | ⊙ | ⊙ | ⊙ | ⊙ |
| | Anti-soiling effect | ⊙ | ⊙ | ⊙ | ⊙ | ⊙ | ○ |
| | Sustainability of anti-soiling effect 1 | ⊙ | ⊙ | ⊙ | ⊙ | ⊙ | ○ |
| | Sustainability of anti-soiling effect 2 | ○ | ○ | ○ | ○ | ○ | ○ |
| | Storage stability 1 | ⊙ | ⊙ | ⊙ | ⊙ | ⊙ | ⊙ |
| | Storage stability 2 | ⊙ | ⊙ | ○ | ○ | ⊙ | ⊙ |

TABLE 3

| | Admixed components | Examples 7 | 8 | 9 | 10 | 11 | 12 |
|---|---|---|---|---|---|---|---|
| A | Organopolysiloxane 1 | 1.0 | | | 1.0 | 2.0 | 2.0 |
| | Organopolysiloxane 2 | | 1.0 | | | | |
| | Organopolysiloxane 3 | | | | | | |
| | Organopolysiloxane 4 | | | | | | |
| | Organopolysiloxane 5 | | | 1.0 | 1.0 | | |
| B | Nonionic surfactant 1 | 3.0 | 3.0 | 3.0 | 3.0 | | |
| | Nonionic surfactant 2 | | | | | 2.5 | |
| | Nonionic surfactant 3 | | | | | 0.5 | |
| | Amphoteric surfactant 1 | 1.0 | 1.0 | 1.0 | 1.0 | 1.0 | 3.0 |
| | Amphoteric surfactant 2 | | | | | | |
| | Cationic surfactant 1 | 0.2 | 0.2 | 0.2 | 0.2 | | |
| | Cationic surfactant 2 | | | | | 0.2 | |
| C | NTA · 3Na | 4.0 | 4.0 | 4.0 | 4.0 | 2.0 | 4.0 |
| | Sodium citrate | | | | | 2.0 | |
| | Citric acid | 0.7 | 0.7 | 0.7 | | | 1.0 |
| | EDTA · 4H | | | | | | |
| D | Deionized water | Balance | Balance | Balance | Balance | Balance | Balance |
| E | Thickener 1 | 0.4 | 0.4 | 0.4 | 1.0 | 0.4 | |
| | Thickener 2 | | | | | | 2.0 |
| F | Diethylene glycol monobutyl ether | | | | | | |
| | Ethanol | | | | | | |
| | Limonene | | | | | | |
| | Acetic acid (pH adjustment) | ○ | ○ | ○ | ○ | | ○ |
| | Sulfuric acid (pH adjustment) | | | | | ○ | |
| | Sodium hydroxide (pH adjustment) | | | | | | |
| Evaluation | pH | 7 | 7 | 7 | 7 | 7 | 7 |
| | Detergency 1 | ⊙ | ⊙ | ⊙ | ⊙ | ⊙ | ⊙ |
| | Detergency 2 | ⊙ | ⊙ | ⊙ | ⊙ | ⊙ | ⊙ |
| | Anti-soiling effect | ⊙ | ⊙ | ⊙ | ⊙ | ⊙ | ○ |
| | Sustainability of anti-soiling effect 1 | ⊙ | ⊙ | ⊙ | ⊙ | ⊙ | ○ |
| | Sustainability of anti-soiling effect 2 | ○ | ○ | ○ | ○ | ○ | ○ |
| | Storage stability 1 | ⊙ | ⊙ | ⊙ | ⊙ | ⊙ | ⊙ |
| | Storage stability 2 | ⊙ | ⊙ | ○ | ○ | ⊙ | ⊙ |

TABLE 4

| | Admixed components | Examples 19 | 20 | 21 | 22 | 23 | 24 |
|---|---|---|---|---|---|---|---|
| A | Organopolysiloxane 1 | | 1.0 | | | | |
| | Organopolysiloxane 2 | 5.0 | | | | | |
| | Organopolysiloxane 3 | | | 1.0 | 2.0 | 2.0 | 2.0 |
| | Organopolysiloxane 4 | | | | | | |
| | Organopolysiloxane 5 | | | | | | |
| B | Nonionic surfactant 1 | 8.0 | 3.0 | 2.0 | 3.0 | | 1.0 |
| | Nonionic surfactant 2 | | | | | 2.0 | |
| | Nonionic surfactant 3 | 2.0 | | 1.0 | | 2.0 | |
| | Amphoteric surfactant 1 | | 1.0 | | 1.0 | | 1.0 |
| | Amphoteric surfactant 2 | 1.0 | | 1.0 | | | 1.0 |
| | Cationic surfactant 1 | 0.2 | 0.2 | 0.2 | 0.2 | | 0.2 |
| | Cationic surfactant 2 | | | | | 0.2 | |
| C | NTA · 3Na | | 4.0 | 12.0 | 4.0 | | 1.0 |
| | Sodium citrate | | | | | | 2.0 |
| | Citric acid | | 0.7 | 2.0 | 0.7 | 5.0 | |
| | EDTA · 4H | 1.0 | | | | | |
| D | Deionized water | Balance | Balance | Balance | Balance | Balance | Balance |
| E | Thickener 1 | | 0.4 | | 0.4 | | |
| | Thickener 2 | | | | | 0.4 | |
| F | Diethylene glycol monobutyl ether | | | 2.0 | | | |
| | Ethanol | | | | | 1.0 | |
| | Limonene | | | | | | |
| | Acetic acid (pH adjustment) | | | ○ | ○ | | |
| | Sulfuric acid (pH adjustment) | | | | | | ○ |
| | Sodium hydroxide (pH adjustment) | ○ | | | | ○ | |
| Evaluation | pH | 7 | 7 | 7 | 7 | 7 | 7 |
| | Detergency 1 | ⊙ | ⊙ | ⊙ | ⊙ | ⊙ | ⊙ |
| | Detergency 2 | ⊙ | ⊙ | ⊙ | ⊙ | ⊙ | ⊙ |

TABLE 4-continued

| Admixed components | Examples 19 | 20 | 21 | 22 | 23 | 24 |
|---|---|---|---|---|---|---|
| Anti-soiling effect | ⊙ | ⊙ | ⊙ | ⊙ | ⊙ | ⊙ |
| Sustainability of anti-soiling effect 1 | ⊙ | ⊙ | ⊙ | ⊙ | ⊙ | ⊙ |
| Sustainability of anti-soiling effect 2 | ○ | ○ | ⊙ | ⊙ | ⊙ | ⊙ |
| Storage stability 1 | ⊙ | ⊙ | ⊙ | ⊙ | ⊙ | ⊙ |
| Storage stability 2 | ⊙ | ⊙ | ⊙ | ⊙ | ⊙ | ⊙ |

TABLE 5

| | Admixed components | Examples 25 | 26 | 27 | 28 |
|---|---|---|---|---|---|
| A | Organopolysiloxane 1 | | | | |
| | Organopolysiloxane 2 | | 0.5 | | |
| | Organopolysiloxane 3 | 5.0 | 1.5 | | 1.5 |
| | Organopolysiloxane 4 | | | 2.0 | 0.5 |
| | Organopolysiloxane 5 | | | | |
| B | Nonionic surfactant 1 | 10.0 | 3.0 | 3.0 | 3.0 |
| | Nonionic surfactant 2 | 2.0 | | | |
| | Nonionic surfactant 3 | | | | |
| | Amphoteric surfactant 1 | 3.0 | 1.0 | 1.0 | 1.0 |
| | Amphoteric surfactant 2 | | | | |
| | Cationic surfactant 1 | | 0.2 | 0.2 | 0.2 |
| | Cationic surfactant 2 | | | | |
| C | NTA · 3Na | | 4.0 | 4.0 | 4.0 |
| | Sodium citrate | | | | |
| | Citric acid | | 0.7 | 0.7 | 0.7 |
| | EDTA · 4H | 1.0 | | | |
| D | Deionized water | Balance | Balance | Balance | Balance |
| E | Thickener 1 | | 0.4 | 0.4 | 0.4 |
| | Thickener 2 | | | | |

TABLE 5-continued

| | Admixed components | Examples 25 | 26 | 27 | 28 |
|---|---|---|---|---|---|
| F | Diethylene glycol monobutyl ether | | | | |
| | Ethanol | | | | |
| | Limonene | | | | |
| | Acetic acid (pH adjustment) | | ○ | ○ | ○ |
| | Sulfuric acid (pH adjustment) | | | | |
| | Sodium hydroxide (pH adjustment) | ○ | | | |
| Evaluation | pH | 7 | 7 | 7 | 7 |
| | Detergency 1 | ⊙ | ⊙ | ⊙ | ⊙ |
| | Detergency 2 | ⊙ | ⊙ | ⊙ | ⊙ |
| | Anti-soiling effect | ⊙ | ⊙ | ⊙ | ⊙ |
| | Sustainability of anti-soiling effect 1 | ⊙ | ⊙ | ⊙ | ⊙ |
| | Sustainability of anti-soiling effect 2 | ⊙ | ⊙ | ○ | ⊙ |
| | Storage stability 1 | ⊙ | ⊙ | ⊙ | ⊙ |
| | Storage stability 2 | ⊙ | ⊙ | ⊙ | ⊙ |

TABLE 6

| | Admixed components | Comparative examples 1 | 2 | 3 | 4 | 5 | 6 |
|---|---|---|---|---|---|---|---|
| A | Organopolysiloxane 1 | | | | | | |
| | Organopolysiloxane 2 | | | | | | |
| | Organopolysiloxane 3 | | | | | | |
| | Organopolysiloxane 4 | | | | | | |
| | Organopolysiloxane 5 | | | | | | |
| | Organopolysiloxane 6 | | | 2.0 | | | 0.5 |
| | Organopolysiloxane 7 | | | | 1.5 | 3.0 | 0.5 |
| B | Nonionic surfactant 1 | 3.0 | 3.0 | 3.0 | 3.0 | | |
| | Nonionic surfactant 2 | | | | | 5.0 | |
| | Nonionic surfactant 3 | | | | | | |
| | Amphoteric surfactant 1 | 1.0 | 1.0 | 1.0 | 1.0 | | 8.0 |
| | Amphoteric surfactant 2 | | | | | | |
| | Cationic surfactant 1 | | 0.2 | 0.2 | 0.2 | | |
| | Cationic surfactant 2 | | | | | | |
| | Anionic surfactant 1 | | | | | | |
| | Anionic surfactant 2 | | | | | | 7.0 |
| C | NTA · 3Na | 4.0 | 4.0 | 4.0 | 4.0 | | |
| | Sodium citrate | | | | | | |
| | Citric acid | 0.5 | 0.5 | 0.5 | 0.5 | | 5.0 |
| | EDTA · 4H | | | | | 1.0 | |
| D | Deionized water | Balance | Balance | Balance | Balance | Balance | Balance |

TABLE 6-continued

| | Admixed components | Comparative examples 1 | 2 | 3 | 4 | 5 | 6 |
|---|---|---|---|---|---|---|---|
| E | Thickener 1 | 0.4 | 0.4 | 0.4 | 0.4 | | |
| | Thickener 2 | | | | | | |
| F | Diethylene glycol monobutyl ether | 3.0 | | | | 6.0 | 1.0 |
| | Ethanol | | | | | 2.0 | |
| | Limonene | | | | | | |
| | Acetic acid (pH adjustment) | ○ | ○ | ○ | ○ | | |
| | Sulfuric acid (pH adjustment) | | | | | | |
| | Sodium hydroxide (pH adjustment) | | | | | ○ | ○ |
| Evaluation | pH | 7 | 7 | 7 | 7 | 7 | 7 |
| | Detergency 1 | ⊙ | ⊙ | ⊙ | ⊙ | ⊙ | ⊙ |
| | Detergency 2 | ⊙ | ⊙ | ⊙ | ⊙ | ⊙ | ⊙ |
| | Anti-soiling effect | X | X | X | X | X | X |
| | Sustainability of anti-soiling effect 1 | X | X | X | X | X | X |
| | Sustainability of anti-soiling effect 2 | X | X | X | X | X | X |
| | Storage stability 1 | ⊙ | ⊙ | ⊙ | ⊙ | ⊙ | ⊙ |
| | Storage stability 2 | ⊙ | ⊙ | ⊙ | ⊙ | ⊙ | ⊙ |

TABLE 7

| | Admixed components | Comparative examples 7 | 8 | 9 | 10 | 11 | 12 |
|---|---|---|---|---|---|---|---|
| A | Organopolysiloxane 1 | 0.01 | | 10.0 | 1.0 | | |
| | Organopolysiloxane 2 | | | 10.0 | | | |
| | Organopolysiloxane 3 | | | | | | 1.0 |
| | Organopolysiloxane 4 | | | | | | |
| | Organopolysiloxane 5 | | 20.0 | | | 1.0 | |
| | Organopolysiloxane 6 | | | | | | |
| | Organopolysiloxane 7 | | | | | | |
| B | Nonionic surfactant 1 | 3.0 | 3.0 | 3.0 | | 0.05 | 30.0 |
| | Nonionic surfactant 2 | | | | | | |
| | Nonionic surfactant 3 | | | | | | |
| | Amphoteric surfactant 1 | 1.0 | 1.0 | 1.0 | | | |
| | Amphoteric surfactant 2 | | | | | | |
| | Cationic surfactant 1 | 0.2 | 0.2 | | | | 5.0 |
| | Cationic surfactant 2 | | | 0.2 | | | |
| | Anionic surfactant 1 | | | | | | |
| | Anionic surfactant 2 | | | | | | |
| C | NTA · 3Na | | | 4.0 | 4.0 | | 4.0 |
| | Sodium citrate | 4.0 | 4.0 | | | | |
| | Citric acid | | | 0.6 | 0.6 | | 0.6 |
| | EDTA · 4H | | | | | 4.0 | |
| D | Deionized water | Balance | Balance | Balance | Balance | Balance | Balance |
| E | Thickener 1 | 0.4 | 0.4 | 0.4 | 0.4 | 0.4 | 0.4 |
| | Thickener 2 | | | | | | |
| F | Diethylene glycol monobutyl ether | 3.0 | 3.0 | | | | |
| | Ethanol | | | | 3.0 | 3.0 | |
| | Limonene | | | | | | 1.0 |
| | Acetic acid (pH adjustment) | | | ○ | ○ | | ○ |
| | Sulfuric acid (pH adjustment) | ○ | ○ | | | | |
| | Sodium hydroxide (pH adjustment) | | | | | ○ | |
| Evaluation | pH | 7 | 7 | 7 | 7 | 7 | 7 |
| | Detergency 1 | ⊙ | ⊙ | ⊙ | Δ | Δ | ⊙ |
| | Detergency 2 | ⊙ | ○ | ○ | X | X | ⊙ |
| | Anti-soiling effect | Δ | ⊙ | ⊙ | ○ | ○ | Δ |
| | Sustainability of anti-soiling effect 1 | X | ⊙ | ⊙ | Δ | Δ | Δ |
| | Sustainability of anti-soiling effect 2 | X | ○ | ○ | X | X | X |
| | Storage stability 1 | ⊙ | X | X | X | X | X |
| | Storage stability 2 | ⊙ | X | X | X | X | X |

TABLE 8

| | Admixed components | Comparative examples 13 | 14 | 15 | 16 | 17 | 18 |
|---|---|---|---|---|---|---|---|
| A | Organopolysiloxane 1 | 2.0 | | 1.0 | | | 1.0 |
| | Organopolysiloxane 2 | | 1.0 | | | 1.0 | |
| | Organopolysiloxane 3 | | | | | | |
| | Organopolysiloxane 4 | | | | | | |
| | Organopolysiloxane 5 | | | | 0.5 | | |
| | Organopolysiloxane 6 | | | | | | |
| | Organopolysiloxane 7 | | | | | | |
| B | Nonionic surfactant 1 | 1.0 | | 3.0 | | 3.0 | 3.0 |
| | Nonionic surfactant 2 | | 0.05 | | | | |
| | Nonionic surfactant 3 | | | | | | |
| | Amphoteric surfactant 1 | 1.0 | | 1.0 | | 1.0 | 1.0 |
| | Amphoteric surfactant 2 | | | | | | |
| | Cationic surfactant 1 | | | 0.2 | 0.2 | 0.2 | 0.2 |
| | Cationic surfactant 2 | | | | | | |
| | Anionic surfactant 1 | 1.0 | | | | | |
| | Anionic surfactant 2 | | 0.4 | | | | |
| C | NTA · 3Na | 4.0 | | | | 0.05 | 30.0 |
| | Sodium citrate | | | | | | |
| | Citric acid | 0.6 | | | | | 7.0 |
| | EDTA · 4H | | 4.0 | | | | |
| D | Deionized water | Balance | Balance | Balance | Balance | Balance | Balance |
| E | Thickener 1 | | | | | 0.4 | |
| | Thickener 2 | | | | | | |
| F | Diethylene glycol monobutyl ether | 20.0 | | 3.0 | | 3.0 | 3.0 |
| | Ethanol | | | | | | |
| | Limonene | | | | | | |
| | Acetic acid (pH adjustment) | ○ | | ○ | ○ | ○ | ○ |
| | Sulfuric acid (pH adjustment) | | | | | | |
| | Sodium hydroxide (pH adjustment) | | ○ | | | | |
| Evaluation | pH | 7 | 7 | 7 | 7 | 7 | 7 |
| | Detergency 1 | ⊙ | ⊙ | X | X | X | ⊙ |
| | Detergency 2 | ⊙ | ○ | Δ | X | Δ | ⊙ |
| | Anti-soiling effect | Δ | Δ | ⊙ | ⊙ | ⊙ | ⊙ |
| | Sustainability of anti-soiling effect 1 | Δ | Δ | ⊙ | ⊙ | ⊙ | ⊙ |
| | Sustainability of anti-soiling effect 2 | X | X | ○ | ○ | ○ | ○ |
| | Storage stability 1 | ⊙ | ⊙ | ⊙ | X | ⊙ | Δ |
| | Storage stability 2 | ⊙ | ⊙ | ⊙ | X | ⊙ | X |

Based on the above results, it can be seen that the compositions of examples 1 to 28 deliver satisfactory performance in terms of test items such as detergency, anti-soiling effect, sustainability of the anti-soiling effect, and storage stability. By contrast, an inferior and poorly sustainable anti-soiling effect is provided by the compositions of comparative examples 1 to 6, which are devoid of the polyetheramide-modified organopolysiloxane and/or amino-modified organopolysiloxane of component (A), or by the composition of comparative example 7, in which the content of component (A) is too low. Inferior storage stability is exhibited by the compositions of comparative examples 8 and 9, in which more than 10 mass % of component (A) is admixed.

Low detergency, a poorly sustainable anti-soiling effect, and inferior storage stability are exhibited by the composition of comparative example 10, which is devoid of the surfactant of component (B), or by the composition of comparative example 11, in which too little of component (B) is admixed. Inferior storage stability and a low and poorly sustainable anti-soiling effect are exhibited by the composition of comparative example 12, in which more than 30 mass % of component (B) is admixed. Inferior and poorly sustainable anti-soiling effect is exhibited by the compositions of comparative examples 13 and 14, which contain an anionic surfactant as component (B).

Inferior detergency is exhibited by the compositions of comparative examples 15 and 16, which are devoid of the metal chelating agent of component (C), or by the composition of comparative example 17, in which too little of component (C) is admixed. It can also be seen that inferior storage stability is exhibited by the composition of comparative example 18, in which more than 20 mass % of component (C) is admixed.

The compositions of examples 7 to 11, 12, and 26 to 28 were used to clean restrooms, washstands, and mirrors in stores, offices, residences, and the like in the same manner as in the tests of sustainability of the anti-soiling effect, and it was found that adequate detergency was exhibited and that satisfactory results were obtained in terms of sustainability of the anti-soiling effect as well.

The invention claimed is:

1. A method for cleaning and/or desoiling a hard surface comprising contacting said hard surface with a composition, said composition comprising:

(A) 0.05 to 10 mass % of a polyetheramide-modified organopolysiloxane;

(B) 0.1 to 30 mass % of at least one type of surfactant selected from the group consisting of nonionic surfactants, amphoteric surfactants, and cationic surfactants;

(C) 0.1 to 20 mass % of a metal chelating agent;

(D) water; and optionally one or both of (E) and (F), wherein (E) 0.01 to 5 mass % of a thickener; and (F) 0.1 to 20 mass % of a water-soluble solvent.

2. The method of claim 1, wherein said polyetheramide-modified organopolysiloxane is expressed by average compositional formula (1)

$$R^1_aR^2_bQ^1_cQ^2_dSiO_{(4-a-b-c-d)/2} \quad (1)$$

and/or expressed by average compositional formula (6)

$$R^1_aR^2_bQ^1_cQ^2_dQ^3_{e1}SiO_{(4-a-b-c-d-e1)/2}$$

where a and d are zeros or positive numbers; b, c, and e1 are positive numbers such that for formula (1) $1.9 \leqq a+b+c+d \leqq 0.2$, and for formula (6) $1.9 \leqq a+b+c+d+e1 \leqq 2.2$; $R^1$ is a hydrogen atom, a hydroxyl group, or a substituted or unsubstituted monovalent hydrocarbon group with 1 to 6 carbon atoms; $R^2$ is a monovalent hydrocarbon group with 1 to 6 carbon atoms; $Q^1$ is a group expressed by general formula (2) or (3)

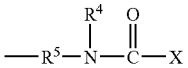

(2)

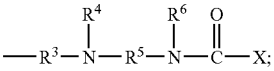

(3)

$R^3$ and $R^5$ are divalent hydrocarbon groups with 2 to 18 carbon atoms; $R^4$ and $R^6$ are hydrogen atoms or monovalent hydrocarbon groups with 1 to 6 carbon atoms; X is a group expressed by general formula (4)

$$—R^7_eO_f—(C_2H_4O)_g—(R^8O)_h—Y \quad (4);$$

e and f are each 0 or 1; g and h are zeros or positive integers of 1 or greater; $R^7$ is a divalent hydrocarbon group with 2 to 18 carbon atoms; $R^8$ is a divalent hydrocarbon group with 3 to 10 carbon atoms; Y is a hydrogen atom, a monovalent hydrocarbon group with 1 to 18 carbon atoms, an acyl group, or an isocyanic acid group; $Q^2$ is a group expressed by general formula (5)

$$—R^9_iO_j—(C_2H_4O)_k—(R^{10}O)_m—Z \quad (5);$$

i and j are each 0 or 1; k is a positive integer of 1 or greater; m is zero or a positive integer of 1 or greater; $R^9$ is a divalent hydrocarbon group with 2 to 18 carbon atoms; $R^{10}$ is a divalent hydrocarbon group with 3 to 10 carbon atoms; and Z is a hydrogen atom, a monovalent hydrocarbon group with 1 to 18 carbon atoms, an acyl group, or an isocyanic acid group; and $Q^3$ is a group expressed by general formula (7) or (8)

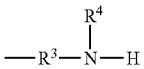

(7)

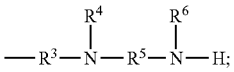

(8)

$R^3$ and $R^5$ are divalent hydrocarbon groups with 2 to 18 carbon atoms; and $R^4$ and $R^6$ are hydrogen atoms or monovalent hydrocarbon groups with 1 to 6 carbon atoms; however d and g cannot both be zero at the same time.

3. The method of claim 1, wherein the thickener of component (E) is at least one compound selected from the group consisting of thickening polysaccharides, carboxyvinyl polymer, crosslinked polyacrylic acids, and salts thereof, and wherein the water-soluble solvent of component (F) is at least one compound selected from the group consisting of alcohols, glycol ethers, and terpene-based hydrocarbon solvents.

4. The method of claim 2, wherein the thickener of component (E) is at least one compound selected from the group consisting of thickening polysaccharides, carboxyvinyl polymers, crosslinked polyacrylic acids, and salts thereof, and wherein the water-soluble solvent of component (F) is at least one compound selected from the group consisting of alcohols, glycol ethers, and terpene-based hydrocarbon solvents.

5. The method of claim 1, wherein said hard surface is plastic, stainless steel, porcelain, tile, glass, ceramic, granite/terrazzo, or other natural stone material, and is found in restrooms, washstands, baths, and other damp locations.

6. The method of claim 2, wherein said hard surface is plastic, stainless steel, porcelain, tile, glass, ceramic, granite/terrazzo, or other natural stone material, and is found in restrooms, washstands, baths, and other damp locations.

7. The method of claim 1, further comprising scrubbing the hard surface.

8. The method of claim 1, further comprising rinsing the composition from the hard surface.

9. The method of claim 1, wherein the hard surface is contacted with the composition for a time sufficient to achieve adequate detergency, anti-soiling effect, and sustainability of anti-soiling effect.

10. The method of claim 1, further comprising contacting the hard surface with a cleaning apparatus.

11. The method of claim 10, wherein the hard surface is contacted using a sponge impregnated with the composition, further comprising scrubbing the contacted hard surface and rinsing the composition from the hard surface.

12. The method of claim 10, wherein the hard surface is a vertical surface contacted by affixing to the vertical surface for a time a nonwoven fabric impregnated with the composition, further comprising rinsing the vertical surface.

13. The method of claim 10, wherein the hard surface is contacted by wiping the hard surface with a towel or duster impregnated with the composition, further comprising wiping the surface with a moist towel.

14. The method of claim 1, wherein the hard surface is contacted by sprinkling with the composition.

15. The method of claim 14, further comprising scrubbing the contacted hard surface and rinsing the composition from the hard surface.

16. The method of claim 1, wherein the hard surface is contacted by spraying the hard surface with the composition.

17. The method of claim 16, further comprising allowing the composition to stand for a time and rinsing the composition from the hard surface.

18. A method for cleaning and/or desoiling a hard surface comprising:

a) contacting the surface comprising soil with a composition comprising:

(A) 0.05 to 10 mass % of a polyetheramide-modified organopolysiloxane;

(B) 0.1 to 30 mass % of at least one type of surfactant selected from the group consisting of nonionic surfactants, amphoteric surfactants, and cationic surfactants;

(C) 0.1 to 20 mass % of a metal chelating agent;

(D) water; and optionally one or both of (E) and (F), wherein (E) 0.01 to 5 mass % of a thickener; and (F) 0.1 to 20 mass % of a water-soluble solvent.

b) maintaining the composition in contact with the hard surface for a time sufficient to remove at least a portion of the soil.

19. The method of claim 18, wherein the portion of the soil removed from the hard surface provides a cleaning ratio of 80% or more.

20. The method of claim 18, wherein the portion of the soil removed from the hard surface provides a cleaning ratio of 60% or more.

* * * * *